United States Patent [19]

Henderson et al.

[11] Patent Number: 4,468,901

[45] Date of Patent: Sep. 4, 1984

[54] PORCH AND STAIR ASSEMBLY FOR MOBILE HOMES

[75] Inventors: Joe W. Henderson; Ronald J. Henderson, both of Claremore, Okla.

[73] Assignee: Hendercraft Metal Works, Inc., Claremore, Okla.

[21] Appl. No.: 428,642

[22] Filed: Sep. 30, 1982

[51] Int. Cl.[3] ..... E04B 1/343

[52] U.S. Cl. ..... 52/79.6; 52/184

[58] Field of Search ..... 52/79.6, 183, 184, 191

[56] References Cited

U.S. PATENT DOCUMENTS

| | | | |
|---|---|---|---|
| 2,551,345 | 5/1951 | Scott | 52/183 |
| 3,626,438 | 12/1971 | Cornell | 52/191 |
| 3,808,757 | 5/1974 | Greenwood | 52/184 |

*Primary Examiner*—James L. Ridgill, Jr.
*Attorney, Agent, or Firm*—Head, Johnson & Stevenson

[57] ABSTRACT

A porch and stairway assembly for a mobile home, or the like, which may be readily assembled or disassembled, and which comprises a porch section, a handrail section and a stairway section, the sections having cooperating interlocking bracket members for sliding and pivoting engagement to readily lock the sections in the assembled relationship and unlock the sections when the porch and stairway assembly is not needed. The entire assembly may be secured together with a minimum number of securing elements, such as bolts, or the like, thus greatly facilitating both the installation and removal of the assembly.

5 Claims, 11 Drawing Figures

PORCH AND STAIR ASSEMBLY FOR MOBILE HOMES

BACKGROUND OF THE INVENTION

1. Field of the Invention

This invention relates to improvements in building structures and more particularly, but not by way of limitation, to a porch and stairway assembly for mobile homes, and the like.

2. Description of the Prior Art

Mobile homes have been increasingly popular for use as permanent living quarters in light of the scarcity of homes and the resultant soaring costs for more conventional residences. As a result, many mobile homes are "permanently" installed at a living site, and are no longer considered movable. These structures are normally provided with a foundation or support base structure upon which the mobile home is mounted, and this arrangement places the normal access door or doors at a height considerably above the normal level of the ground upon which the home is disposed. In order to facilitate the entry to and exit from the interior of the home, it is a frequent practice to arrange a series of building blocks, or the like, to provide a "makeshift" stepping arrangement between the ground and the door. It will be readily apparent that this solution to the problem is not only unsightly, but is dangerous in that the stepping onto or off of these somewhat haphazard arrangements is difficult.

SUMMARY OF THE INVENTION

The present invention contemplates a novel porch and stairway assembly particularly designed and constructed for use with a mobile home during such times that the home is in a substantially permanent location. The novel structure may be easily assembled and installed on the home for facilitating access to the door and providing a porch area for improving the appearance and usefulness of the home. In addition, the novel structure may be readily disassembled for storage in the event the mobile home is to be moved to a different location. The novel assembly comprises a planar section providing a porch for disposition in the proximity of the door of the home, and adjustable support members or legs for supporting the porch in a substantially horizontal level plane regardless of the contour of the terrain upon which the assembly is being installed. A stairway section comprising a pair of spaced mutually parallel rail means having step plates or stair treads mounted therebetween is arranged for ready installation at either end of the porch section, as desired for the particular location of the overall assembly. The tread elements are secured to the spaced rail means in such a manner that the plane of each of the tread elements remain mutaully parallel and are disposed in a horizontal plane when installed in combination with the porch section. A hand rail section is engagable with the outer periphery of the porch section and along at least one side of the stairway section, and is readily attachable thereto in a manner for securing both the porch section and stairway section in the erected and assembled positions thereof. A minimum number of securing bolts, or the like, is required for fastening the entire assembly together, thus facilitating both the installation and disassembly thereof.

When the entire assembly has been installed in the proximity of the door of a mobile home, or the like, not only is the use of the door greatly facilitated, but also the overall appearance of the entire home is greatly improved. The novel porch and stairway assembly is simple and efficient in operation and economical and durable in construction.

DETAILED DESCRIPTION OF THE PREFERRED EMBODIMENT

Figure 5:
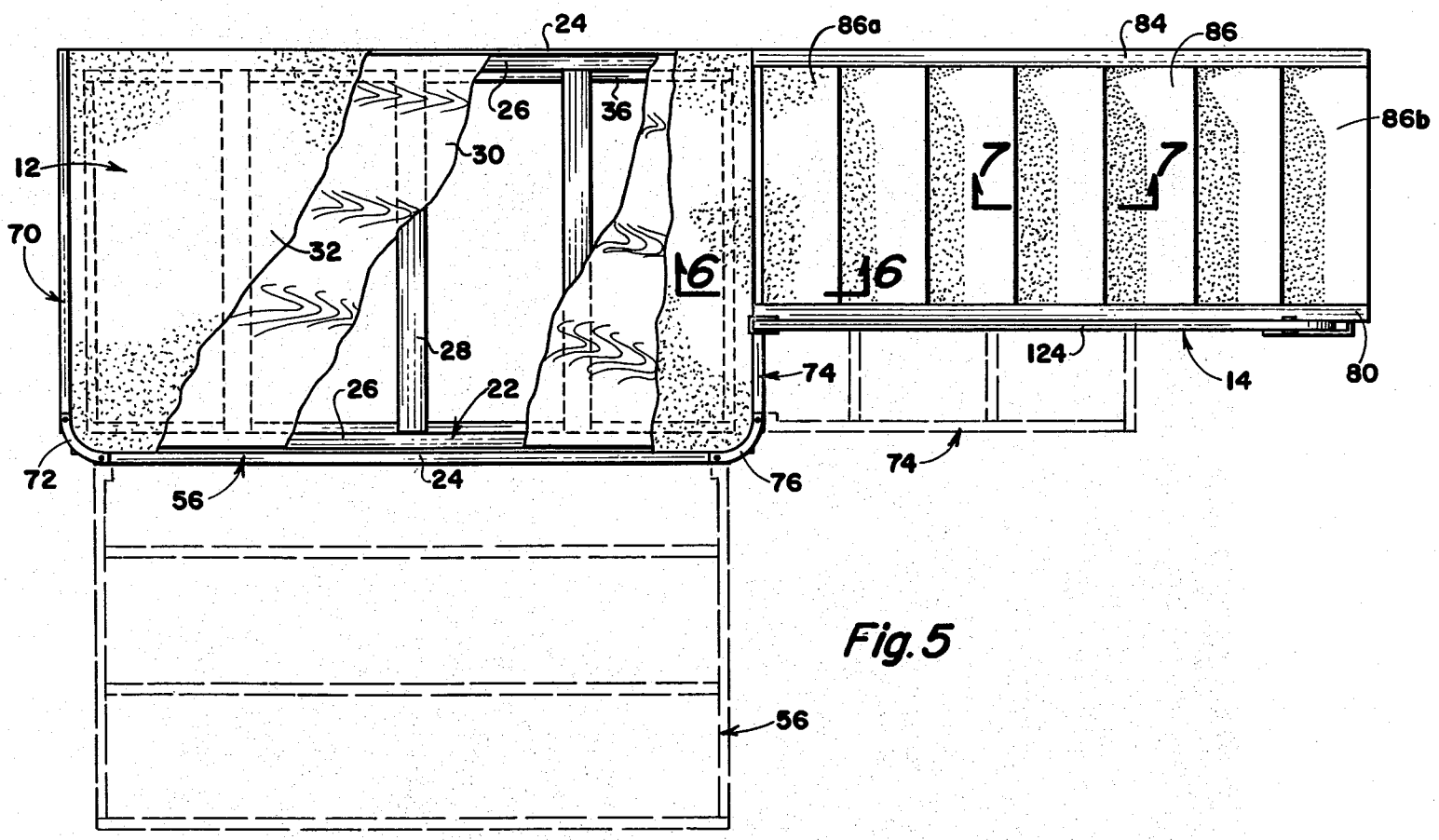
FIG. 5 is a plan view of a porch and stairway assembly embodying the invention, with one assembled position thereof shown in solid lines and an alternate position thereof shown in broken lines.

Referring to the drawings in detail, reference character 10 generally indicates a porch and stairway assembly comprising a porch section 12, a stairway section 14 and a hand rail section 16, and particularly designed and constructed for installation in the proximity of a door 18 of a mobile home structure 20, or the like. The porch section 12 comprises an open frame 22, preferably of a substantially rectangular planar configuration, but not limited thereto, and constructed from angle iron, or the like providing an upstanding leg 24 and an inwardly directed horizontally disposed leg 26 (FIG. 5). A plurality of longitudinally spaced slats or cross members 28 are welded or otherwise secured to the oppositely disposed legs 26 and extend transversely therebetween to provide support for a plate 30 which functions as a floor for the porch section 12. It will be readily apparent that the plate 30 may be constructed from any suitable material, such as plywood, and may be subsequently covered with any desired flooring material, such as indoor-outdoor carpet 32, or the like, as desired, to improve the appearance and utilitarian characteristic of the porch section.

A sleeve 34 is welded or otherwise rigidly secured to each corner of the frame 22 and extends substantially perpendicularly outward therefrom for a purpose as will be hereinafter set forth. In addition, an apron or flange member 36 extends around the periphery of the frame 22 and is spaced slightly inwardly from the upstanding leg 24. In addition, the apron 36 may be welded between the sleeves 34, or otherwise rigidly secured in position, as desired. Further, suitable gusset members 38 may be welded between the sleeves 34 and the adjacent portions of the outer edge of the apron 36 for strength and rigidity, as is well known.

Figure 6:
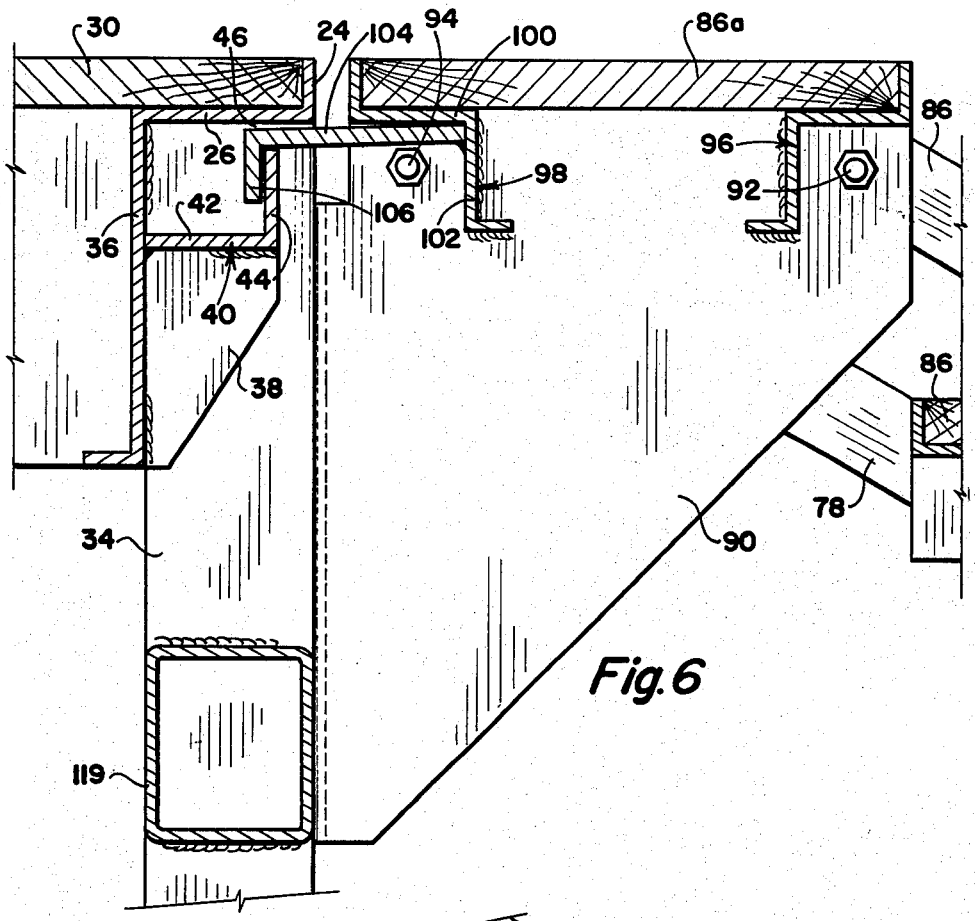
FIG. 6 is a view taken on line 6—6 of FIG. 5.

A bracket member 40 of substantially L-shaped cross-sectional configuration is welded, or otherwise secured to the outer surface of the apron 36 in the proximity of each side of the sleeves 34. Each bracket 40 comprises a first leg member 42 extending substantially perpendicularly outwardly from the outer plane of the apron 36, and a second leg member 44 disposed substantially parallel with the plane of the apron 36 and spaced outwardly therefrom, as particularly shown in FIG. 6. The leg 44 extends in a direction toward the element 26 and terminates in spaced relation with respect thereto providing a hiatus 46 therebetween for a purpose as will be hereinafter set forth.

A post means 48 is slidably disposed within each of the sleeves 34 to provide support leg means for the assembly 10. It is preferably that each leg means 48 be adjustably secured to the respective sleeve member 34 whereby the overall length of each leg may be adjusted in accordance with the surface contours of the ground or terrain wherein the assembly 10 is to be installed. Whereas the adjustable connection between the legs 48 and sleeves 34 may be as desired, as shown herein, each sleeve 34 is preferably provided with at least one pair of axially aligned bores 50 (only one of each being shown in the drawings) for selected alignment with any of a plurality of longitudinally spaced bores 52 provided in each leg 48. When the desired bore 52 of the leg 48 is in alignment with the bore 50 of the sleeve 34 to provide the optimum length for the leg, suitable securing means, such as a bolt 54 may be inserted through the aligned bores for securing the leg 48 in the selected position with respect to the respective sleeve 34.

Figure 11:
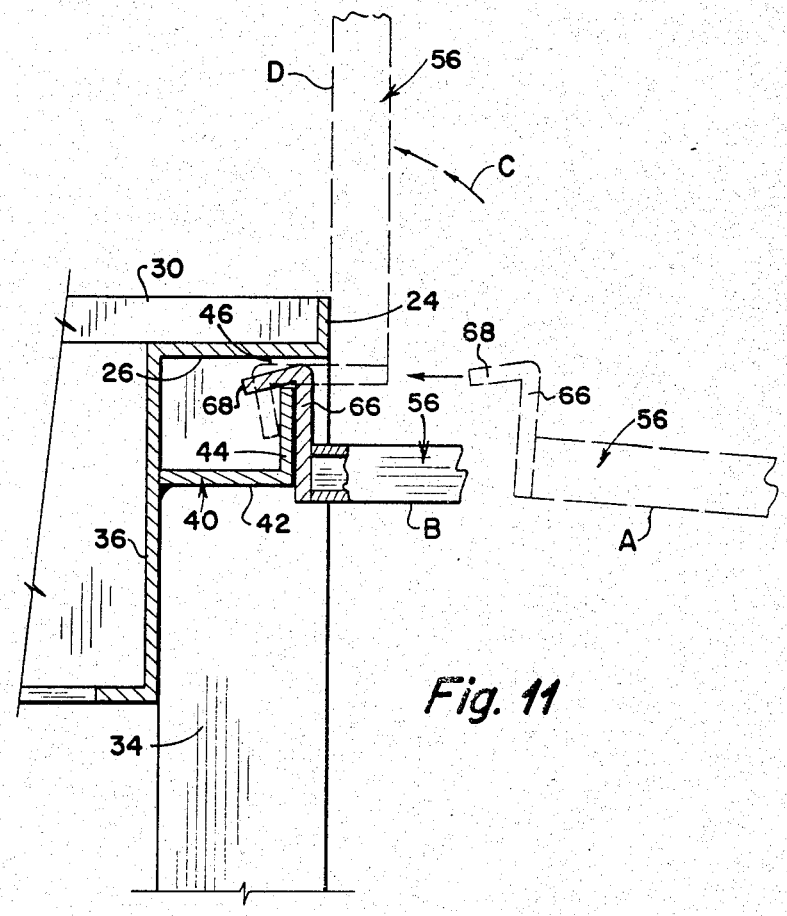
FIG. 11 is an enlarged sectional view illustrating a typical installation of the hand rails section to the porch and stairway sections.

The rail section 16 comprises a first side rail assembly 56 adapted to be disposed along the outer longitudinal edge of the frame 22 and comprises a pair of spaced upstanding support post members 58 and 60 having a top rail member 62 secured therebetween and a plurality of intermediate rail members 64 secured therebetween in substantially parallel spaced relation with respect to the top rail 62. The outer or lower end of each post 58 and 60 is provided with a plate or flange member 66 (FIG. 11) having an outwardly and angularly extending flange 68 at the outer end thereof. In order to install the rail assembly 56 in assembled relation with respect to the porch section, the entire rail assembly 56 may be initially placed in a substantially horizontal position, as shown in broken lines at A in FIG. 11. The flange 68 may be moved into substantial alignment with the hiatus 46, and may be inserted therethrough, for positioning the plate 66 in abutment with the leg 44 of the bracket 40, as shown in solid lines at B in FIG. 11. The rail assembly 56 may then be pivoted upwardly, as indicated by the arrows C, until the assembly is in an upright position as shown in broken lines at D in FIG. 11. The plate 66 and flange 68 are thus securely locked in position by the bracket 40, and since each leg 58 and 60 are similarly locked in position with the respective bracket 40, the entire assembly 56 is securely retained in place with respect to the porch section 10.

The porch section 16 further comprises an end rail assembly 70 of a generally similar construction as the side rail assembly 56, with the exception that the end rail assembly is normally of a shorter length than the side rail assembly. It is to be noted, however, that the planar dimensions of the porch member 30 may be substantially as desired, and is not limited to the rectangular configuration shown herein. The end rail assembly 70 is secured to the porch member 30 may be substantially any configuration as desired and is not limited to the rectangular configuration shown herein. The end rail assembly 70 is secured to the porch section 12 in the same manner as hereinbefore set forth in connection with the side rail assembly 56. When the two rail sections are thus assembled with the porch section, an angle member 72 may be placed over the adjacent ends of the upper rail members thereof and may be bolted or otherwise secured thereto, thus securely retaining the rails sections in place.

It is preferably to provide at least one end or side edge of the porch section with means for securing the step assembly 14 thereto. Thus, it is preferable to provide a bracket **40*a* at some position spaced from the corner bracket 40 on at least one side of the apron 36 as particularly shown in FIG. 1. It is preferable that the bracket 40*a* be placed in such a position as to provide a sufficient clearance for securing the step assembly 14 to the said side of the apron 36 as will be hereinafter set forth. In addition, the bracket 40 is substantially identical to the brackets 40 and is for the same purpose. It is also preferable to provide another end rail assembly 74 for this end of the porch assembly, the rail assembly 74 being of a similar construction as the rail assemblies 56 and 70, but of a length corresponding to the spacing between the brackets 40 and 40*a*. The rail assembly 74 is secured in position in the manner as hereinbefore set forth, and an angle member 76 similar to the angle member 72 may be placed between the top rail members of the two adjacent rail assemblies 74 and 56 and bolted or otherwise secured in place. It will be apparent that the entire rail section 16 may be secured in assembled relation with respect to the porch section by the use of only four bolts, or the like, thus providing for great ease of installation of the assembly 10**.

The stairway section 14 is so constructed that the plane of each of the steps of the stairway is always parallel to the plane of the other steps, regardless of the angle at which the section 14 must be positioned in the installation of the assembly 10. The stairway section 14 comprises a first pair of elongated substantially aligned, mutually parallel, spaced side rails or members 78 and 80 disposed in substantial transverse alignment with a pair of similar spaced side rails or members 82 and 84, (FIG. 1), respectively. A plurality of stair steps or treads 86 are secured between the transversely spaced pairs of side rails 78–80 and 80–82 in spaced relation with respect to one another. The upper end of the rails 78–80 and 82–84 as shown in the drawings are pivotally secured to a pair of spaced substantially triangular plates 88 and 90 in any suitable manner such as by pivot pins 92 and 94.

The uppermost step **86*a* as shown in the drawings is supported by a pair of substantially identical but oppositely disposed cross members 96 and 98 welded or otherwise secured to the plates 88 and 90. Each cross member 96 and 98 is preferably of a cross section configuration generally resembling a first L-shaped flange 100 disposed in a substantially horizontal position and supporting a substantially vertically extending L-shaped flange 102, as particularly shown in FIG. 6. One of the cross members, such as the cross member 98 is provided with an outwardly extending flange 104 having an angularly extending flange 106 at the outer end thereof for engagement with a bracket 40** in the manner as hereinbefore set forth in connection with the rail assemblies.

Figure 7:
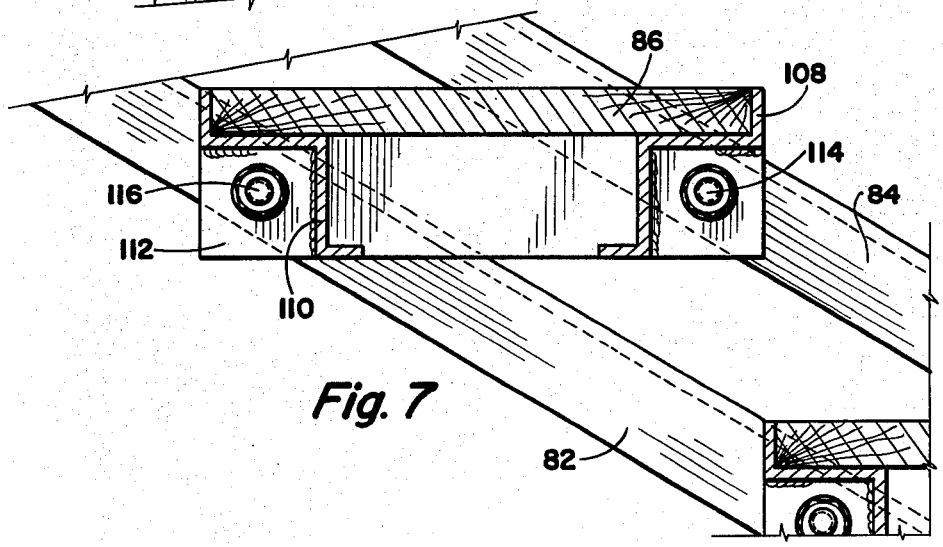
FIG. 7 is a view taken on line 7—7 of FIG. 5.

Each of the remaining steps 86 are supported by cross members 108 and 110 (FIG. 7) generally similar to the cross members 96 and 98. The cross members 108 and 110 are welded or otherwise secured between a pair of plate members 112, and each plate member 112 is pivotally secured between the transversely aligned rail members 78–80 and 82–84 by means of bolts 114 and 116, or the like. In this manner, each step 86 is pivotally secured between the side rail members and a plurality of parallelograms are provided whereby each of the steps remains in a planar parallel relationship with each of the other steps regardless of the angular position of the rail members 78–80 and 82–84.

Figure 1:
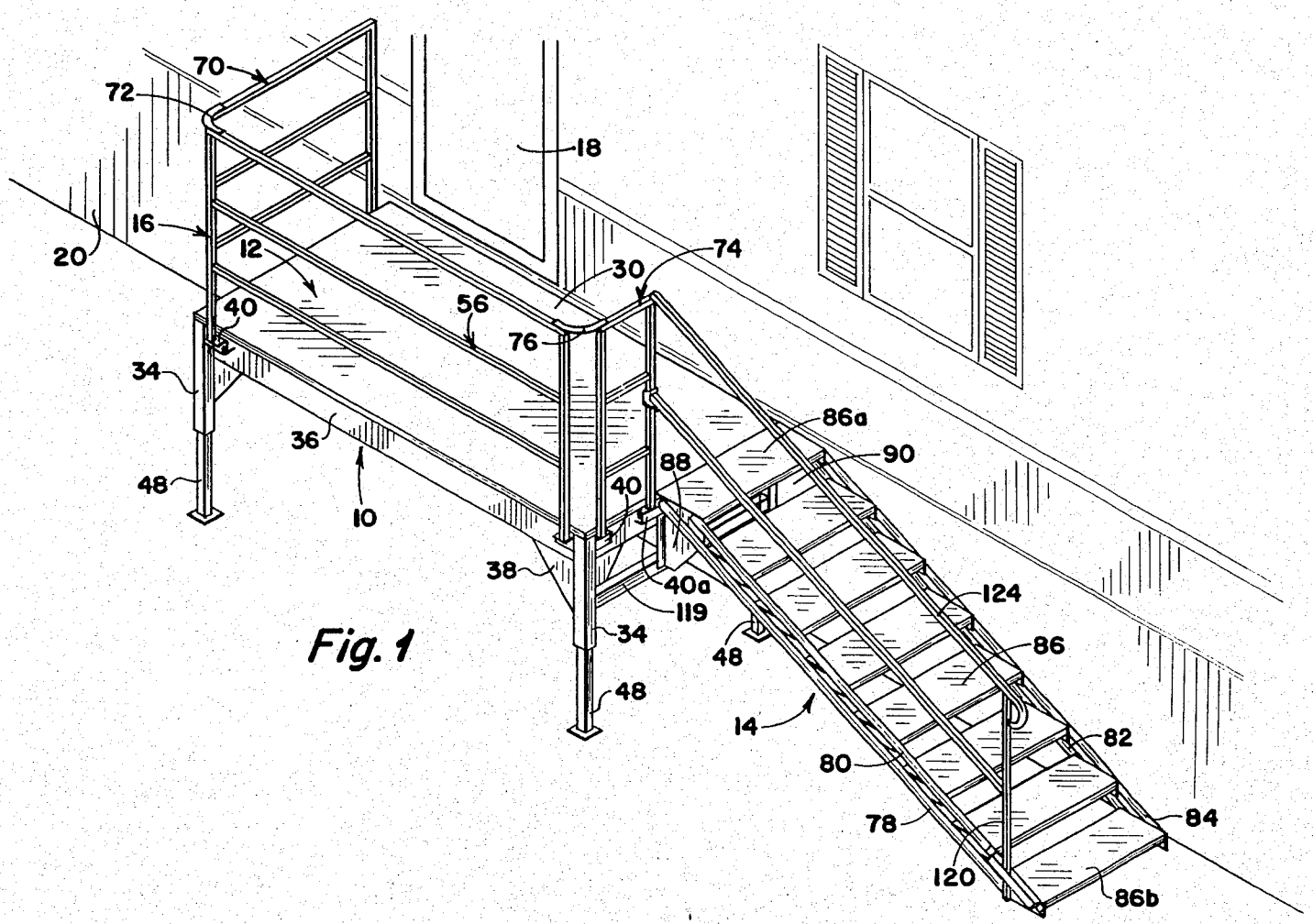
FIG. 1 is a perspective view of a porch and stairway assembly embodying the invention and illustrated installed in combination with a mobile home.
Figure 2:
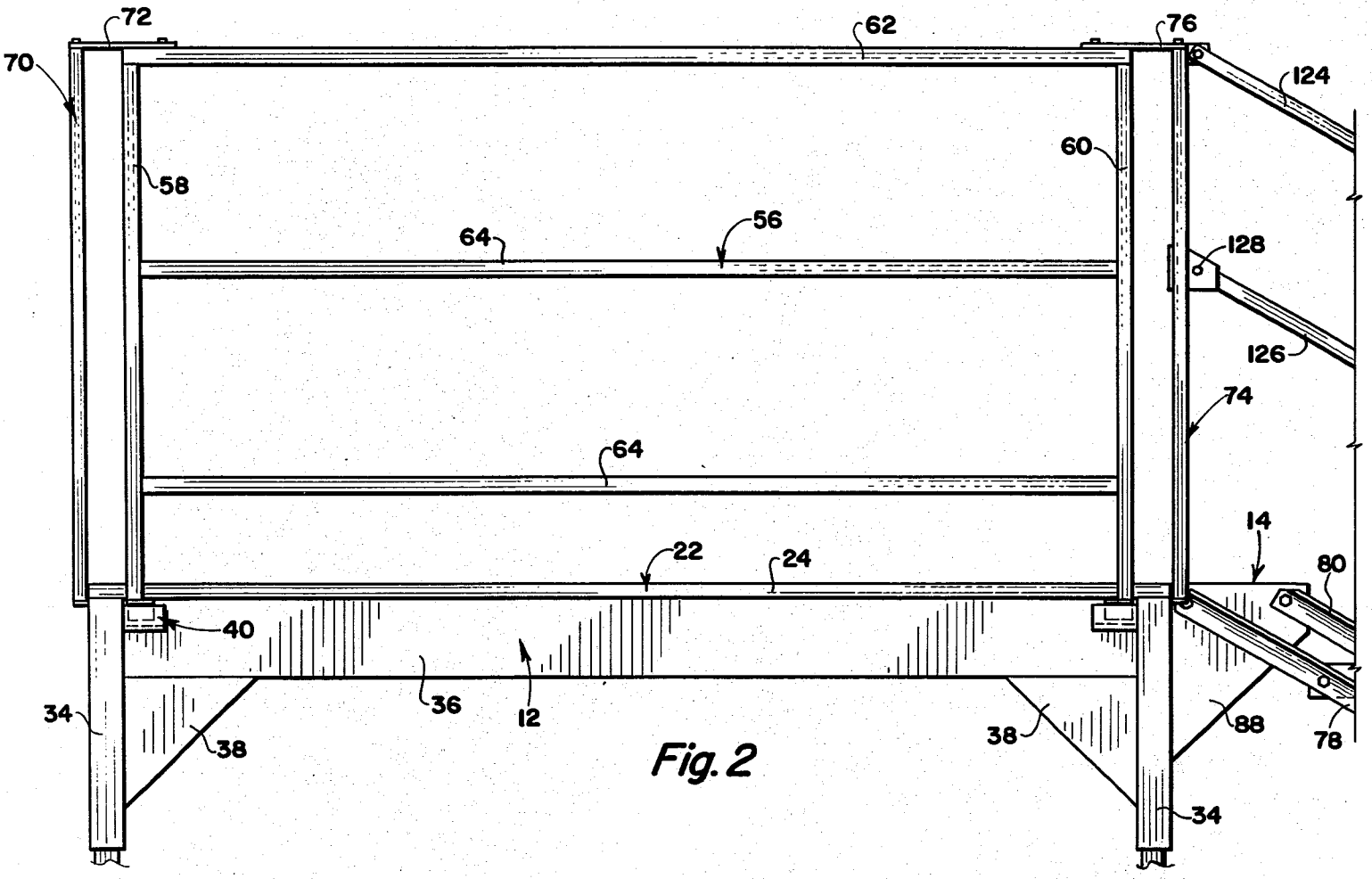
FIG. 2 is an elevational view of the porch section of a porch and stairway assembly embodying the invention, with a portion of the stairway section in connection therewith.
Figure 3:
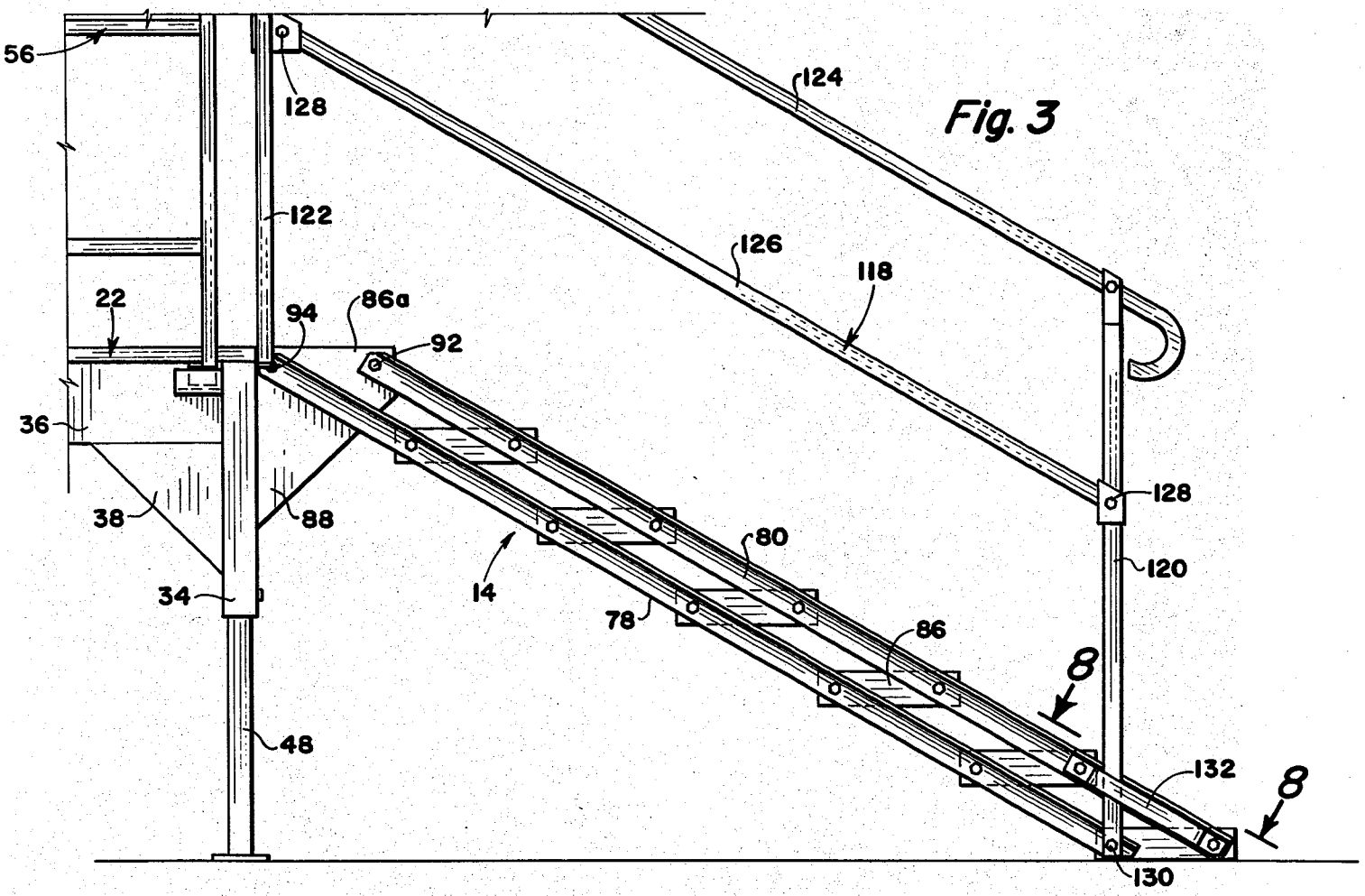
FIG. 3 is an elevational view of the stairway section of a porch and stairway assembly embodying the invention, with a portion of the porch section illustrated in connection therewith.
Figure 4:
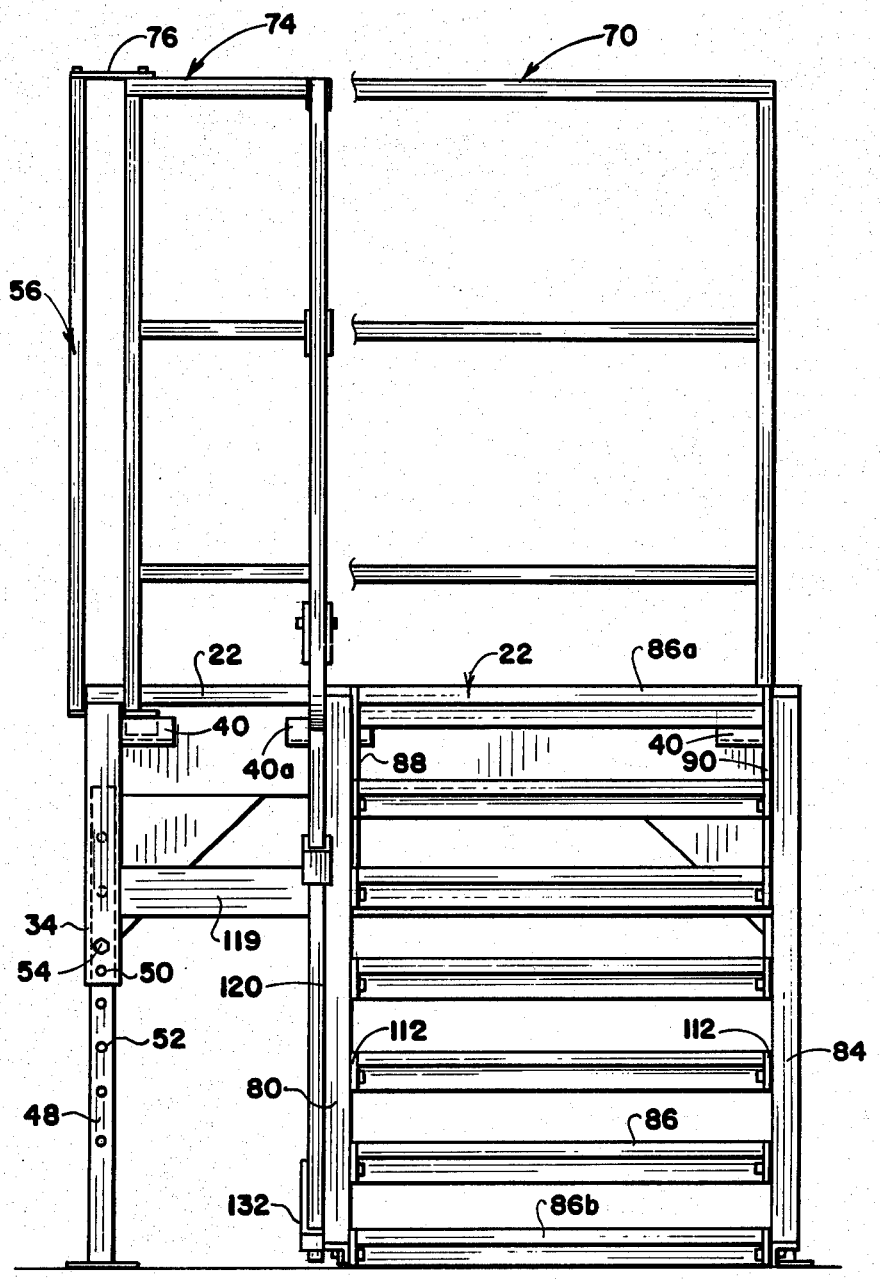
FIG. 4 is an end elevational view of a porch and stairway assembly embodying the invention, with a portion thereof cut away for purposes of illustration.
Figure 8:
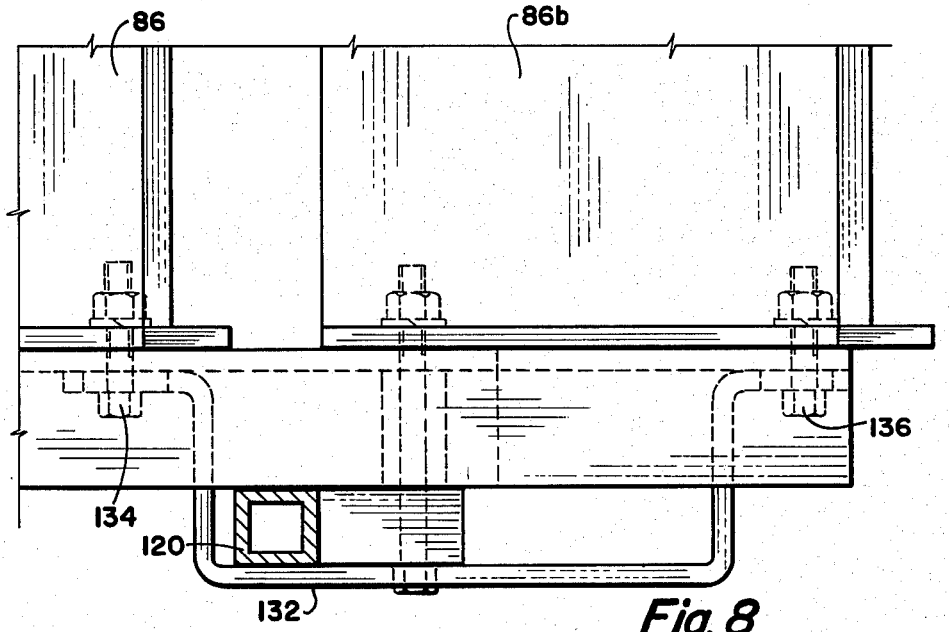
FIG. 8 is a view taken on line 6—6 of FIG. 3.
Figure 9:
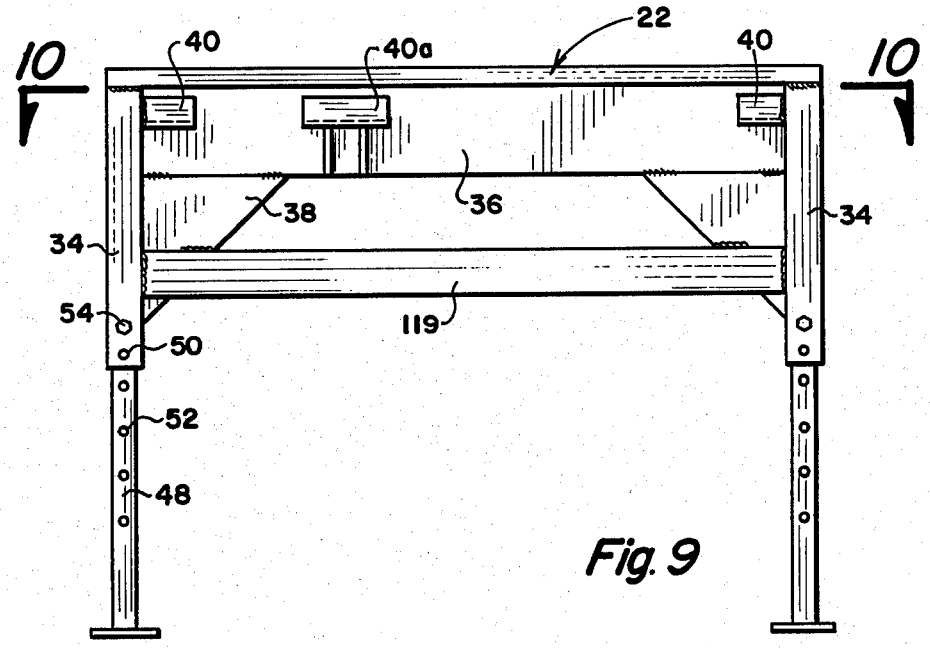
FIG. 9 is an end elevational view of the porch section of a porch and stairway assembly embodying the invention, with the porch section being illustrated as installed prior to the addition of the stairway and hand rail sections thereto.

In addition, a hand rail assembly 118 comprising a pair of upstanding end posts 120 and 122 having a top hand rail 124 and at least one intermediate longitudinally extending rail 126 secured therebetween. The ends of the rails 124 and 126 are pivotally secured to the posts 120 and 122 in any suitable manner, such as by pivot pins 128. In addition, one end of the post 120 is pivotally secured to the side member 78 as shown at 130 in FIG. 3 and the post 122 is pivotally secured to the opposite end of the side member 78 at a point spaced above the lower end of the post 122 in any suitable manner (not shown). The post 122 extends slidably through a substantially U-shaped bracket 132 (FIG. 8) which is secured to the outer surface of the side member 80 in any suitable manner, such as by bolts 134 and 136. A substantially identical hand rail assembly may be provided for the side members 82 and 84, if desired, but as a practical matter, it has been found that upon the installation of the porch assembly 10 in the proximity of the wall of the mobile home 20, as shown in FIG. 1, a single hand rail assembly 118 is sufficient.

It is preferably to provide a cross member 119 secured between the sleeves 34 at the end of the frame 22 wherein the stairway assembly 14 is to be installed.

Figure 10:
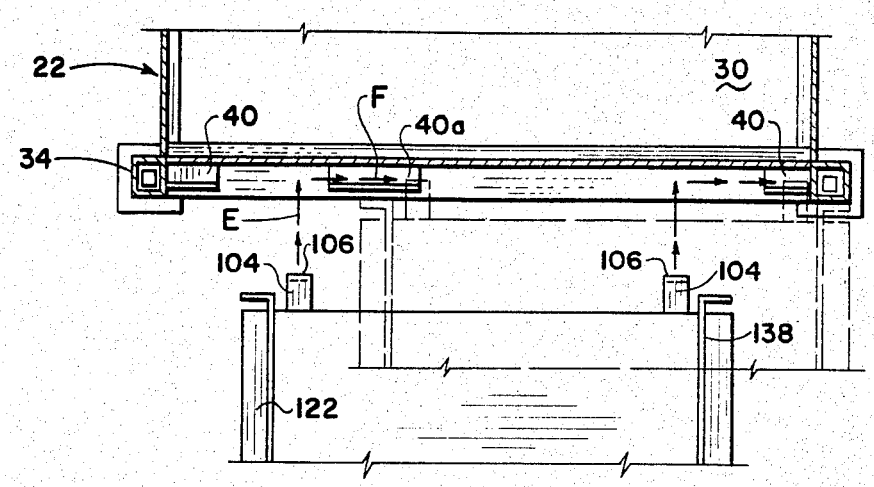
FIG. 10 is a view taken on line 10—10 of FIG. 9.

In order to install the stairway section 14 in connection with the porch section 12, the assembly 14 may be manually maneuvered in such a manner as to position the flange members 104 in spaced relation with respect to the end of the frame 22 wherein it is desired to install the stairway, and in a slightly offset relationship with respect to the brackets 40 and **40*a* as particularly shown in FIG. 10. The entire assembly 14 may then be moved in a direction toward the apron 36, as shown by the arrows E in FIG. 10. When the flanges 106 have been positioned in substantial alignment with the hiatus between the apron 36 and the brackets 40 and 40*a*, the entire assembly 14 may be moved in a direction toward the brackets as shown by the arrows F in FIG. 10. When the flanges 106 are engaged with the brackets 40 and 40*a* in the manner as hereinbefore set forth in connection with the installation of the rail assemblies 56, 70 and 74, the stairway assembly 14 may be pivoted downwardly whereby the outermost step 86*b* will be positioned in the proximity of the surface of the ground, as will be particularly seen in FIG. 1. In this position the plates 88 and 90 will abutt the cross member 119. Of course, it will be apparent that it may be desirable to provide a second upstanding post 138 (FIG. 10) at the opposite end of the upper step 86*a* with respect to the post 122**, but there is no limitation to the use of such a second post.

Whereas the particular porch and stairway assembly 10 shown herein includes a substantially rectangular porch floor 30, it will be apparent that the porch floor 30 may be square, or substantially any other suitable configuration, as desired. In addition, it is preferable that the frame 22 be of a symmetric construction whereby the stairway section 14 may be secured to either end of the porch and is not limited to the particular relationship with respect to the porch floor 30 as shown herein. Of course, if desired, the stairway section 14 may be installed in such a manner as to extend perpendicularly outwardly from the mobile home 20 rather than substantially parallel thereto as shown herein.

In order to install the assembly 10 in the proximity of the door 18 to provide an attractive and efficient porch structure therefor, the porch section 12 may be erected in the manner as hereinbefore set forth, and the legs 48 adjusted whereby the floor 30 is disposed substantially level in a horizontal position regardless of the contour of the ground upon which the assembly 10 is mounted. One edge of the frame 22 may be placed in an abutting relationship with the outer wall of the mobile home 20, and it may be desirable to secure the porch section thereto in any suitable manner (not shown), but it is to be understood that the assembly may be entirely separate from the mobile home 20, if desired.

The stairway section 14 may then installed at the desired location and in the manner as hereinbefore set forth, it being noted that the upper surface of each of the steps 86 will be positioned in a substantially level horizontal position and in a parallel planar relationship with each of the other steps due to the novel parallelogram type construction of the section 14. When the stairway section 14 has been properly installed, the handrail section 74 may be installed in the manner as hereinbefore set forth. The installation of the handrail section 74 outboard of the stairway section 14, as shown in FIG. 1 causes the handrail assembly 74 to retain the installed section 14 against outward movement, thus precluding an accidental disengagement of the section 14 from the porch section 12. The handrail sections 56 and 70 may also be installed in connection with the porch section 12 as hereinbefore set forth, and the angle members 72 and 76 may be bolted in place for retaining the handrail sections 56, 70 and 74 in the upright position therefor.

The entire installation operation or assembly procedure for the porch and stairway assembly 10 is simple and efficient and requires a minimum of bolts, or the like, for retaining the assembly in the installed relationship between the sections thereof. In addition, in the event the mobile home 20 is to be moved, or for any other reason, it is desired to remove the assembly 10 from the proximity thereof, the assembly 10 may be quickly and easily disassembled by reversing the foregoing operations, whereupon the entire assembly 10 may be stored in a storage area of minimum size.

From the foregoing it will be apparent that the present invention provides a novel porch and stairway assembly for a mobile home, or the like, which comprises a porch section, a handrail section and a stairway section, all of which may be readily assembled together with a minimum of effort and tools since only a minimum number of bolts are required for securing all of the sections in the assembled relationship. The novel assembly may be stored in a minimum area when not in use, and may be quickly and easily installed or removed from the proximity of the mobile home as desired.

Whereas the present invention has been described in particular relation to the drawings attached hereto, it should be understood that other and further modifications, apart from those shown or suggested herein may be made within the spirit and scope of this invention.

What is claimed is:

1. A porch and stairway assembly particularly for mobile homes and comprising a porch section, a handrail section, a stairway section, and complementary bracket means cooperating between the sections for ease of assembly and disassembly of the porch and stairway assembly; the porch section including an open frame means supporting a porch floor means, and adjustable support leg means secured to the frame means for positioning of the porch floor means in a substantially level horizontal position regardless of the contour upon which the porch section is installed; and wherein the complementary bracket means comprises first bracket means of substantially L-shaped cross-sectional configuration secured to the open frame means and providing a hiatus therebetween, second bracket means of substantially L-shaped cross-sectional configuration provided on the handrail section for an interlocking and removable engagement with the first bracket means for ease of installation of the handrail section with the porch section without the use of additional securing means, and third bracket means provided on the stairway section for an interlocking and removable engagement with the first bracket means for ease of installation of the stairway section with the porch section without the use of additional securing means.

2. A porch and stairway assembly as set forth in claim 1 wherein the handrail section means comprises a plurality of independent handrail assemblies each removably securable to the porch section, and means interconnecting adjacent handrail assemblies whereby the entire porch and stairway assembly is locked in the assembled position thereof.

3. A porch and stairway assembly as set forth in claim 1 wherein the handrail section comprises a plurality of independent handrail assemblies, each handrail assembly comprising a pair of end post means having at least one handrail member secured therebetween.

4. A porch and stairway assembly as set forth in claim 1 wherein each of the end post means is provided with said complementary bracket means for engagement with the porch section means.

5. A porch and stairway assembly as set forth in claim 1 wherein the stairway section comprises a pair of longitudinally extending spaced siderail means having a plurality of step means pivotally secured therebetween, the pivotal connection between the step means and the side rail means providing parallelogram means whereby the plane of each step means is maintained in parallel relationship with the plane of each of the other step means.

* * * * *